US012630329B2

(12) United States Patent
Hihn et al.

(10) Patent No.: US 12,630,329 B2
(45) Date of Patent: May 19, 2026

(54) REUSABLE SHINGLE CARRY AND STORAGE CONTAINER

(71) Applicants: Derick E. Hihn, Charlestown, IN (US); Douglas A. Kieper, Sellersburg, IN (US)

(72) Inventors: Derick E. Hihn, Charlestown, IN (US); Douglas A. Kieper, Sellersburg, IN (US)

( * ) Notice: Subject to any disclaimer, the term of this patent is extended or adjusted under 35 U.S.C. 154(b) by 0 days.

(21) Appl. No.: 18/987,962

(22) Filed: Dec. 19, 2024

(65) Prior Publication Data

US 2025/0197050 A1 Jun. 19, 2025

Related U.S. Application Data

(60) Provisional application No. 63/612,270, filed on Dec. 19, 2023.

(51) Int. Cl.

| | |
|---|---|
| ***B65D 5/20*** | (2006.01) |
| ***B65D 5/22*** | (2006.01) |
| ***B65D 5/44*** | (2006.01) |
| ***B65D 5/46*** | (2006.01) |
| ***B65D 5/49*** | (2006.01) |

(52) U.S. Cl.

CPC ..... *B65D 5/2052* (2013.01); *B65D 5/22* (2013.01); *B65D 5/445* (2013.01); *B65D 5/46024* (2013.01); *B65D 5/48024* (2013.01)

(58) Field of Classification Search

CPC ..... B65D 5/2052; B65D 5/22; B65D 5/445; B65D 5/46024; B65D 5/48024

USPC ..... 206/323

See application file for complete search history.

(56) References Cited

U.S. PATENT DOCUMENTS

| | | | | |
|---|---|---|---|---|
| 3,889,868 | A * | 6/1975 | Bruckner | B65D 5/6661 229/125 |
| 6,016,911 | A * | 1/2000 | Chen | B65D 5/6664 206/459.1 |
| 11,613,400 | B1 * | 3/2023 | Hogan | B65D 5/6661 229/208 |
| 2018/0354675 | A1 * | 12/2018 | Chou | B65D 5/20 |
| 2025/0304315 | A1 * | 10/2025 | Phung | B65D 5/241 |

* cited by examiner

*Primary Examiner* — Jacob K Ackun

(74) *Attorney, Agent, or Firm* — Dinsmore & Shohl LLP

(57) ABSTRACT

A shingle carry and storage container is constructed of a single piece of flexible continuous and contiguous planar substrate having a pair of opposed long sides and a pair of opposed short sides to form a generally rectangular shape. A plurality of spaced parallel longitudinal creases are provided in the substrate that define a rear end panel, a top panel, a bottom panel, a bottom front panel, and a top front panel. Furthermore, a pair of opposed parallel side creases in the substrate spaced from the short sides normal to the longitudinal creases define a pair of opposed side panels having tabs on the ends for folding over and assembling the container.

20 Claims, 11 Drawing Sheets

REUSABLE SHINGLE CARRY AND STORAGE CONTAINER

FIELD OF THE INVENTION

The apparatus and various embodiments disclosed relate generally to a collapsible and reusable carry and storage container.

BACKGROUND OF THE INVENTION

Asphalt shingles are a type of wall or roof covering that incorporate asphalt for waterproofing purposes and in ubiquitous use for roofing for homes and buildings of all types. Generally, two types of base or substrate materials are used to make asphalt shingles, organic mat and fiberglass mat formed with an asphalt-saturated base covered on one or both sides of the shingles, outer and inner. The exposed outer surface of the shingle is typically impregnated with slate, schist, quartz, vitrified brick, stone, or ceramic granules, and the inner or under side is typically treated with sand, talc or mica to prevent shingles from sticking to one-another before use. The top surface granules act to block ultra-violet light, which causes the shingles to deteriorate, provide some physical protection of the asphalt core, and provide color or aesthetic enhancement.

Self-sealing semi-adhesive strips are standard on the underside of shingles to provide resistance to lifting in high winds. This material is typically limestone or fly-ash-modified resins, or polymer-modified bitumen. An additive known as styrene-butadiene-styrene (SBS), sometimes called modified or rubberized asphalt, is sometimes added to the asphalt mixture to make shingles more pliable, resistant to thermal cracking, and more resistant to damage from hail impacts. Furthermore, some manufacturers use a fabric backing known as a scrim on the inner side of shingles to make them more impact resistant.

Fiberglass reinforcement was devised as the replacement for asbestos in organic mat shingles. Fiberglass shingles have a base layer of glass fiber-reinforced mat made from wet, random-laid glass fibers bonded with urea-formaldehyde resin. This mat is then coated with asphalt-containing mineral fillers to make it waterproof. Such shingles resist fire better than those with organic/paper mats.

Asphalt shingles come in two standard design options: architectural (also known as dimensional) shingles, and three-tab shingles. Three-tab shingles are essentially flat simple shingles with a uniform shape and size. Architectural (or dimensional) shingles are thicker and stronger, vary in shape and size, and offer more aesthetic appeal; casting more distinct, random shadow lines better mimics the appearance of traditional roofing materials such as wood shake shingles. All asphalt shingle roofs are replaced typically between a 15-50 year period.

The dimensions of shingles are relatively standard across the industry. A typical shingle is approximately 12 to 18 inches wide, 36 to 40 inches long, and less than ½ inch thick. The standard size of a typical three-tab asphalt shingle is generally 12 inches long by 36 inches wide. This rectangular shape overlaps with neighboring shingles to create a weather-tight seal. Architectural shingles are typically larger than 3-tab shingles, often measuring around 14 inches by 39 inches.

Generally speaking, shingles are stacked together and sold as bundles weighing from 40 to 80 pounds. These bundles are generally rigid but pliable, which makes them difficult to handle and subject to damage during shipping and handling. Generally, shingle bundles are wrapped in heavy paper to keep the bundle together, while enabling quick unwrapping during shingle installation since the paper is simply torn off and discarded by the installers.

Shipping, carry, and storage containers for all types of contents are typically boxes, crates, or bags adapted to be filled with small and large parcels as well as letters, pouches and elongated products such as tubes. A container may be filled with articles all constituting the same product or a mixture of products.

General merchandise shipping boxes are conventionally manufactured as polymer resin crates, often in the form of sealed boxes or a corrugated fiber board or "cardboard" box which may be collapsed and erected for use. Flaps form the top and bottom, folded and taped to seal the bottom of the box. The top flaps may be connected to one another with tape, hook and loop fasteners, ties, string, or other fastening members such as staples.

Plastic containers or crates need to be scrubbed periodically with high-pressure and high-temperature fluids, such as water, soap, and the like. They tend to be more expensive than cardboard corrugated boxes, and when damaged must often be destroyed. Moreover, sanitizing plastic containers can be expensive and time consuming.

Erected fiberboard, cardboard, or plastic corrugated boxes usually have a bottom that has been folded and taped in order to support the box erected from a flattened condition to a rectangular box shape. The top flaps fold outward and down around the box, or the flaps are left in the extended open position presenting impediments to users filling such boxes. In short, the top flaps tend to form obstacles. Flaps connecting to one another standing vertically force the user to bend over to reach down into the box to place anything on the bottom of the box, or flaps extending away from the box walls form a horizontal stand off pushing the user away from the interior of the box. Flaps typically tend to fold inward, and when closed, angle inwardly thereby obstructing access to the interior of the box. Thus, each item placed requires the user to either hold the flaps out of the way, or to reach in and pull the flaps back in order to add each respective item to a conventional box. Complete removal of the flaps or elimination of the flaps obstruct a user's access to the box is desirable.

Cardboard type boxes are less expensive and often disposable, i.e., they can be cut down, baled into bales, and returned to a paper manufacturing company for recycling. However, the plastic tape used to seal these boxes must be removed from the recycled fibers. Boxes secured with staples and other fasteners and/or glues also present recycling issues. Moreover reuse of boxes is complicated because the volume of boxes is typically disproportionate to the items contained therein and they are large compared to their weight. Stripping off tape, tearing out staples, destroys the box so that reuse is impractical.

Thus there is a need in the art for a storage box or container that is heavy and robust enough to hold and protect shingles while also being quick to assemble and easily disposed of when necessary.

SUMMARY OF THE INVENTION

The shingle carry and storage container disclosed herein comprises a single sheet of pliable substrate material, preferably a corrugated cardboard sheet of material in a knocked-down configuration which is erected to form a box. A semi-rigid corrugated material fabricated from paper or plastic in one or more layers at a selected thickness, for example, three millimeters is used for the planar substrate. The shingle container is a continuous and contiguous structure foldable into a reusable, knock-down box completely connected and sealed at all locations except the lid closure. The shingle container can be easily erected to an assembled condition with a minimum of effort and movement without the use of tools. Furthermore, the shingle container does not require removal of tape, glue, staples, or any disposable fasteners in order to return the container to its original knocked-down configuration.

The embodiments of the shingle container disclosed herein comprise or consist of a collapsible reusable carry and storage container formed from a single piece of planar substrate material such as corrugated cardboard or plastic material as a continuous and contiguous structure, foldable into a re-usable, knock-down box. The carry and storage container includes a bottom base panel connecting to a top panel by a rear end panels whereby side panels and a front panel are formed by overlapping flaps extending therefrom at right angles.

The present invention allows roofers to buy the shingle carry and storage shingle container and place a bundle of shingles matching those used on the roof of the customer into a single carry and storage container. The container will contain the roofers shingle sample, warranty and other information and/or business cards for easy access by the homeowner. The homeowner will retain the carry and storage container for future reference and referral to friends and family. The carry and storage container contains an entire bundle of shingles effective for repairs of a roof making matching of new shingles easy when necessary.

The single piece of corrugated material includes a plurality of scored or creased regions extending along the longitudinal edges of the panels allowing folding of the panels between a flat position and erected position whereby the panels are disposed at 90 degree angles from one another forming a box.

The side panels include a medial longitudinal crease (or score line or seam) on the outer surface of each side panel permitting the panels to fold inwardly when the box is collapsed to a flat state. Similarly, the front and rear panels may be either creased or scored longitudinally at a plurality of points to permit the front end panel and rear end panel to fold down toward the bottom of the container. The bottom side panels and top side panels overlap with the top front panel tabs cooperatively engaging the bottom front panel tabs when the container is closed. In addition, the rear end panel top tab cooperatively engages the rear end panel bottom tab upon closure of the container.

A re-sealable label pouch is affixed to a surface of the container at a selected location to hold information regarding the builder or contractor. A pouch or envelope may also be formed inside the container to hold advertising information with regard to the description of the shingle and manufacturer or distributor. The container may be maintained in the sealed condition with no tape, sealers, staples or the like. Alternately, for security, any edges may be sealed. Nevertheless, the box need not sustain any damage other than a certain amount of wear if no fasteners are used.

Accordingly, it is an object of the embodiments disclosed to fabricate a shingle container from a corrugated material, in order to be able to hold up to a 100 pound bundle of shingles. In additional embodiments and aspects, the container disclosed herein utilizes special folds to provide the requisite structural strength to withstand heavy contents without requiring tape or adhesive closure.

In some embodiments, the shingle container includes a collapsible handle for shipping as well as a moisture-resistant or waterproof coating on the outer surface of the shingle container, such as black ink to resist degradation upon being exposed to moisture in a garage, basement, shed, barn, etc., and to retain structural integrity for an extended time period.

In some additional embodiments, the handle of the shingle container may include a backer plate rated for 100 lb. to provide a container that is both durable and capable of withstanding a drop without spilling the internal shingles.

Furthermore, in certain embodiments, the shingle container includes an internal pocket to retain shingle/roof information securely for the convenience of a homeowner, as well as an external pocket for retention of roofer business cards for future referrals to provide a long term marketing opportunity for the roofer, where business cards and company name and contact information are prominent and readily accessible to the homeowner.

Each of the embodiments disclosed herein provide a secure and clean method of storing shingles, which are notoriously messy and susceptible to damage and allow shingles to be easily moved for cleaning or organizing storage locations such as garage. Thus the described container embodiments enable a roofer or homeowner to quickly assemble, organize, transport, and store a bundle of spare shingles, that are often notoriously unruly to handle.

It should be appreciated that all combinations of the foregoing concepts and additional concepts discussed in greater detail below (provided such concepts are not mutually inconsistent) are part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

Other features, objects and advantages of the present invention will become apparent from the Brief Description of the Drawings taken in conjunction with the appended drawing Figures, wherein like reference characters generally refer to the same parts throughout the different view. The drawings are not necessarily to scale. Emphasis is instead generally placed upon illustrating the principles of the disclosure.

DESCRIPTION OF THE PREFERRED EMBODIMENTS

Figure 1:
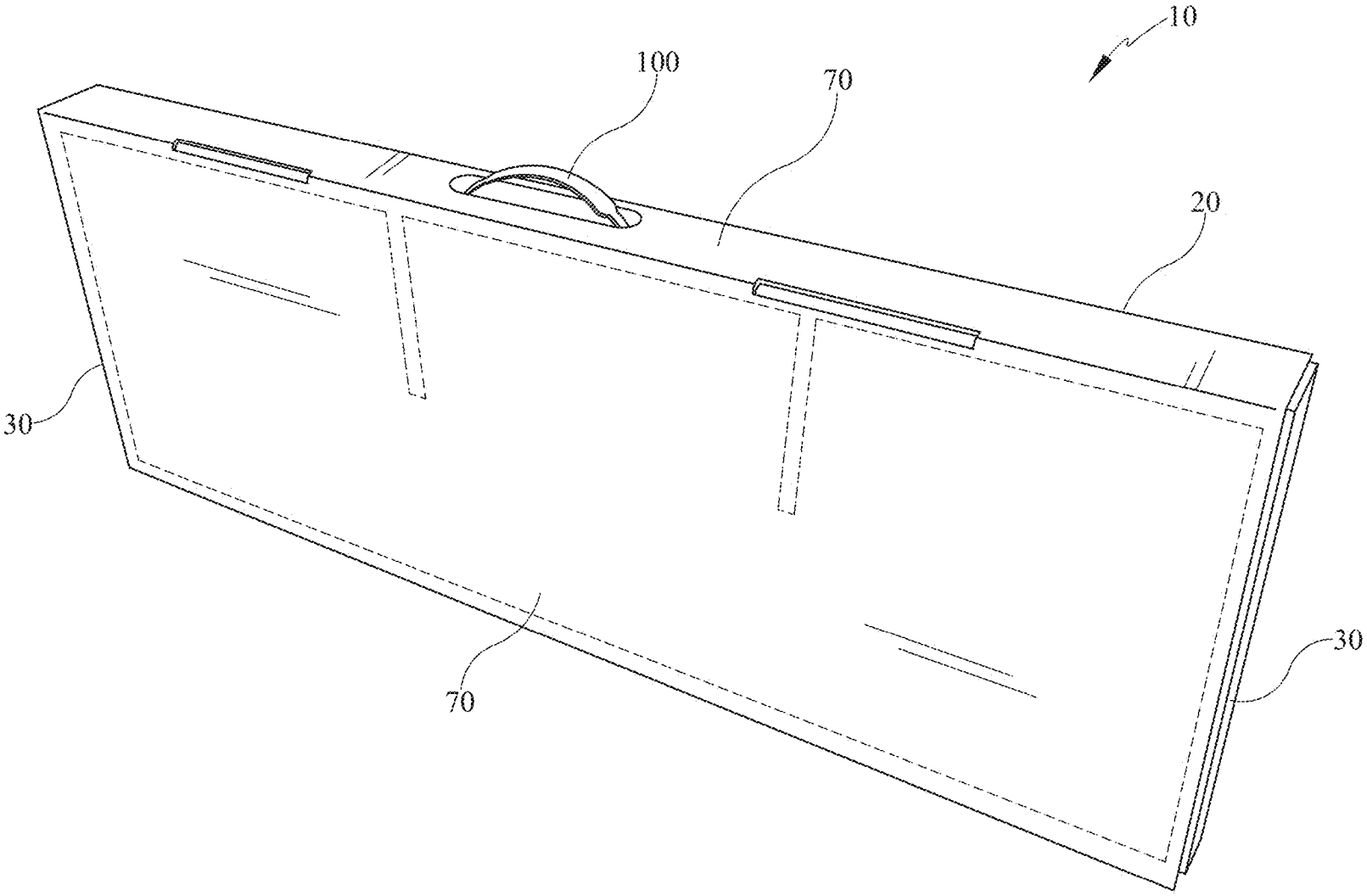
FIG. 1 is an perspective view of an assembled reusable knock-down carry and storage container in accordance with some embodiments.

Referring now to the drawing Figures, and in particular FIGS. 1-5 a shingle carry and storage container 10 is formed from a single piece of flexible planar substrate 20 as a continuous and contiguous structure foldable into a reusable, knock-down box 10, that is easily and quickly assembled by a user 1. In some embodiments, the planar material substrate 20 is corrugated paper or cardboard having a plurality of creases (or seams and/or score lines) as detailed below.

More particularly, in accordance with some embodiments, a reusable collapsible carry and storage container 10 is constructed from a single piece of flexible continuous and contiguous planar substrate 20 comprising a corrugated or generally flat sheet of material 22. Material 22 may in some embodiments comprise at least one layer but may be a multi-layer sheet of material 22. In some exemplary but non-limiting embodiments, material 22 may comprise a corrugated and/or laminated cardboard sheet. It will be appreciated that a variety of materials 22 may be used as substrate 20 without departing from the scope of the preferred embodiments.

Figure 3:
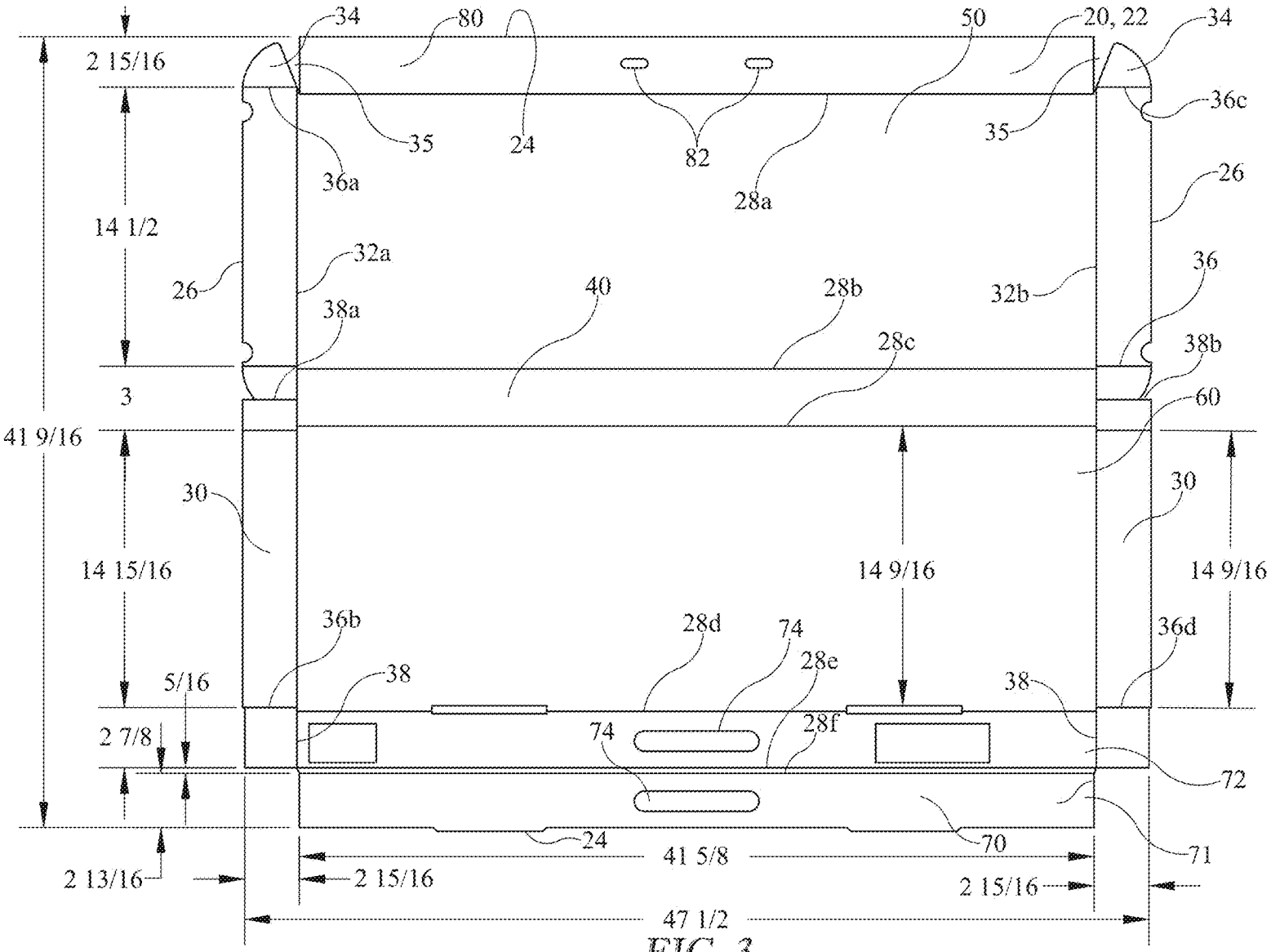
FIG. 3 is a dimensioned plan view of an unassembled reusable knock-down carry and storage container in accordance with some embodiments.

As best seen in FIG. 3, planar substrate 20 has a pair of opposed long sides 24 and a pair of opposed short sides 26 to form a generally rectangular shape. Substrate 20 is formed or manufactured having a plurality of spaced apart parallel longitudinal creases 28*a-f* (or seams or scores 28*a-e*). In exemplary embodiments, creases 28*b*, 28*c* define and form a rear end panel 40 disposed therebetween. A top panel 50 is disposed between creases 28*a* and 28*b* and one long side 24. An opposing bottom panel 60 is disposed between creases 28*c* and 28*d*, and one long side 24. In the exemplary embodiment of container 10 depicted in FIG. 3, six (6) longitudinal generally parallel creases 28*a-f* are provided to define and separate substrate 20 into rear end panel 40, top panel 50, bottom panel 60, bottom front panel 70, and top front panel 80.

Referring again to FIG. 3, in some aspects and embodiments, planar substrate 20 further includes a pair of opposed side panels 30 extending from short sides 26 of planar sheet 20 normal to longitudinal creases 28*a-f* and defined by side creases 32*a*, 32*b* provided in substrate 20. Additionally, side panels 30 may include a pair of top end tabs 34 proximate top panel 50 on either side thereof. Top end tabs 34 may be shaped such that a small void or separation 35 is provided between top end tabs 34 and top front panel 80 to facilitate construction of container 10 as side panels 30 are folded to permit top end tabs 34 to cooperatively engage top front panel 80 and bottom front panel 70 as will be discussed further herein below. Furthermore, a plurality of creases 36 *a-d* and cuts or perforations 38*a*, 38*b*, may be provided at various areas of substrate 20 to facilitate construction of container 10 as depicted. For example, cuts 38 *a*, 38*b* on side panels 30 enable a user 1 to fold portions of side panels 30 inwardly to engage bottom top panel 70 and top front panel 80 to assemble container 10 as detailed further below.

Still referring to FIG. 3, a bottom front panel 70 is provided and defined by a pair of longitudinal creases 28*d*, 28*e*, 28*f*, in substrate 20 proximate bottom panel 60 creates a bottom front panel 70 that includes two front sections 71, 72 which may be folded together at a 90 degree angle from bottom panel 60 and overlap each other. In some aspects and embodiments, bottom front panel 70 sections 71, 72 each includes a handle slot 74 therein such that when sections 71, 72 are folded together, overlap to form a single handle slot 74 with a double-thickness of substrate 20 formed by bottom front panel 70 sections 71, 72.

Figure 2:
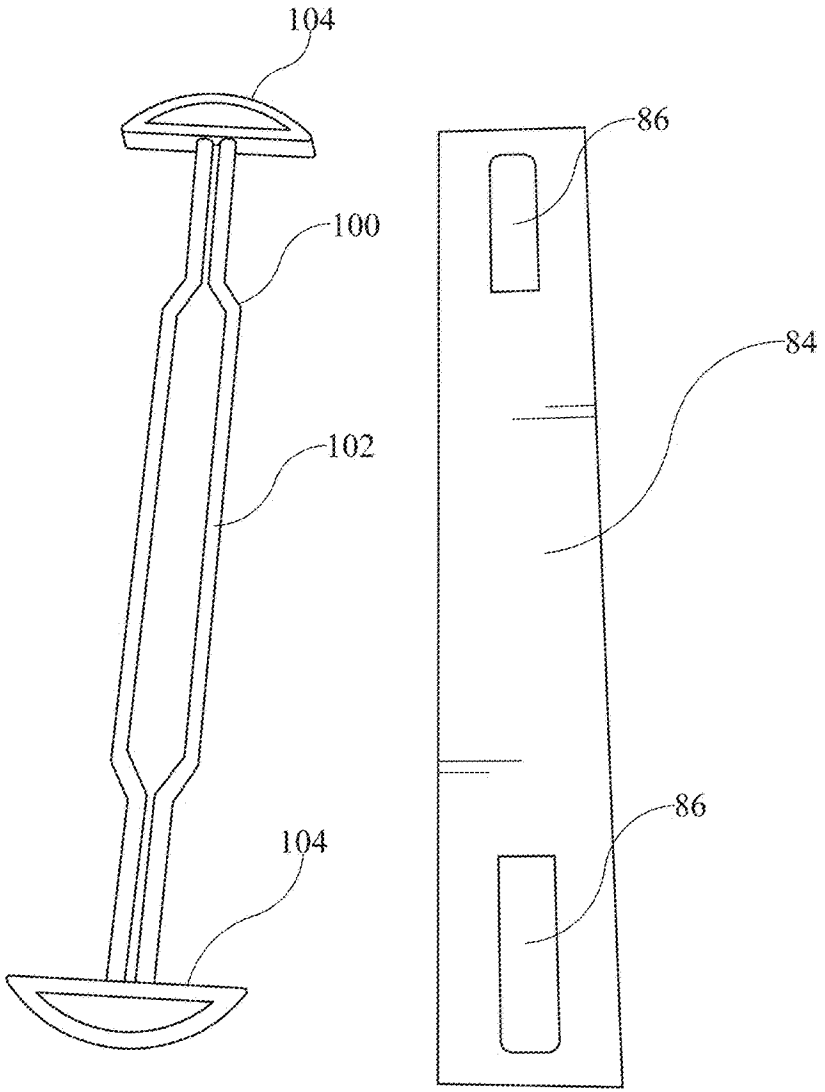
FIG. 2 is a perspective view of a handle assembly for a reusable knock-down carry and storage container in accordance with some embodiments.
Figure 4:
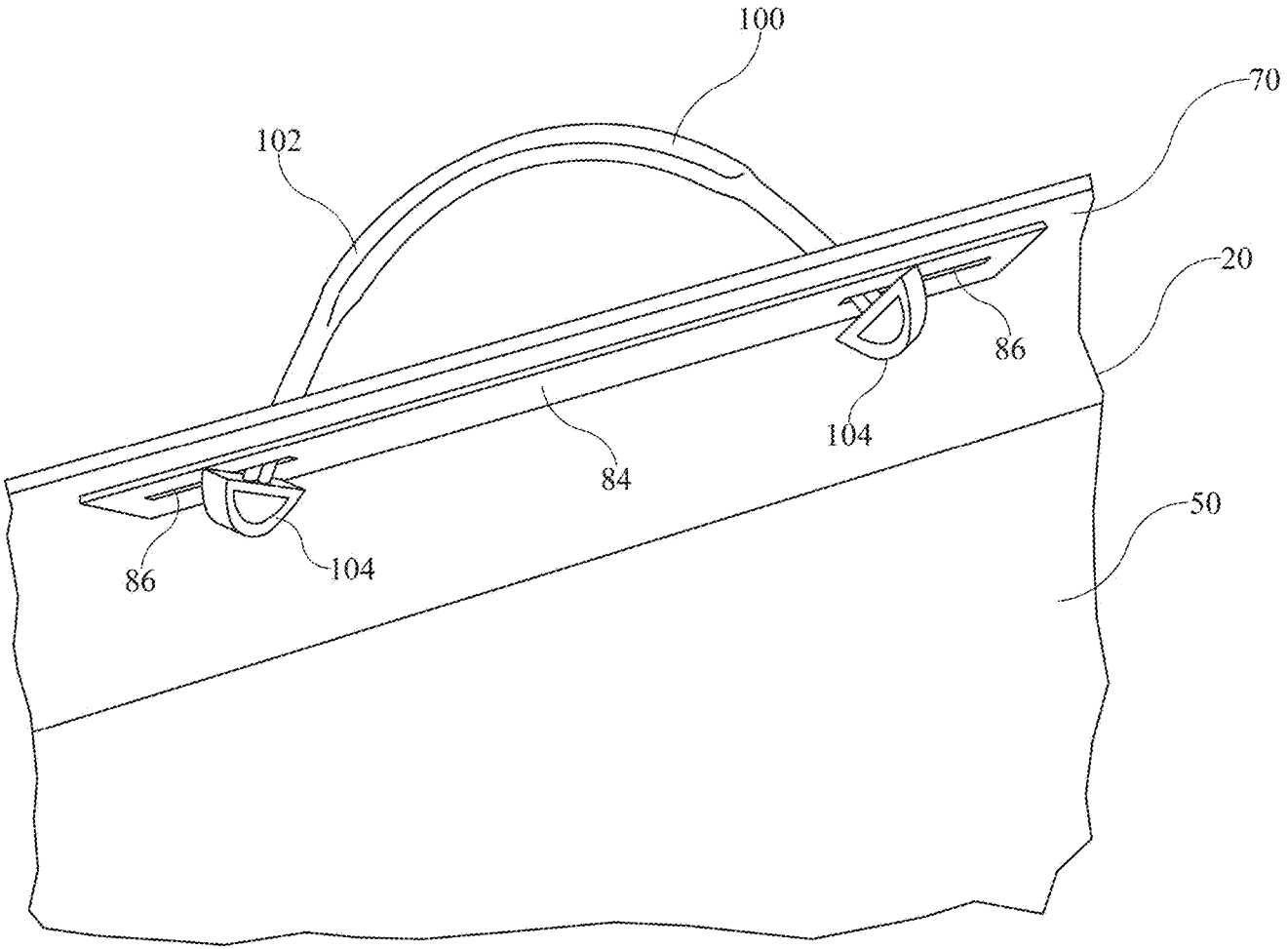
FIG. 4 is a perspective view of a handle and reinforcement backing in cooperative engagement with a handle assembly in accordance with some embodiments.
Figure 5:
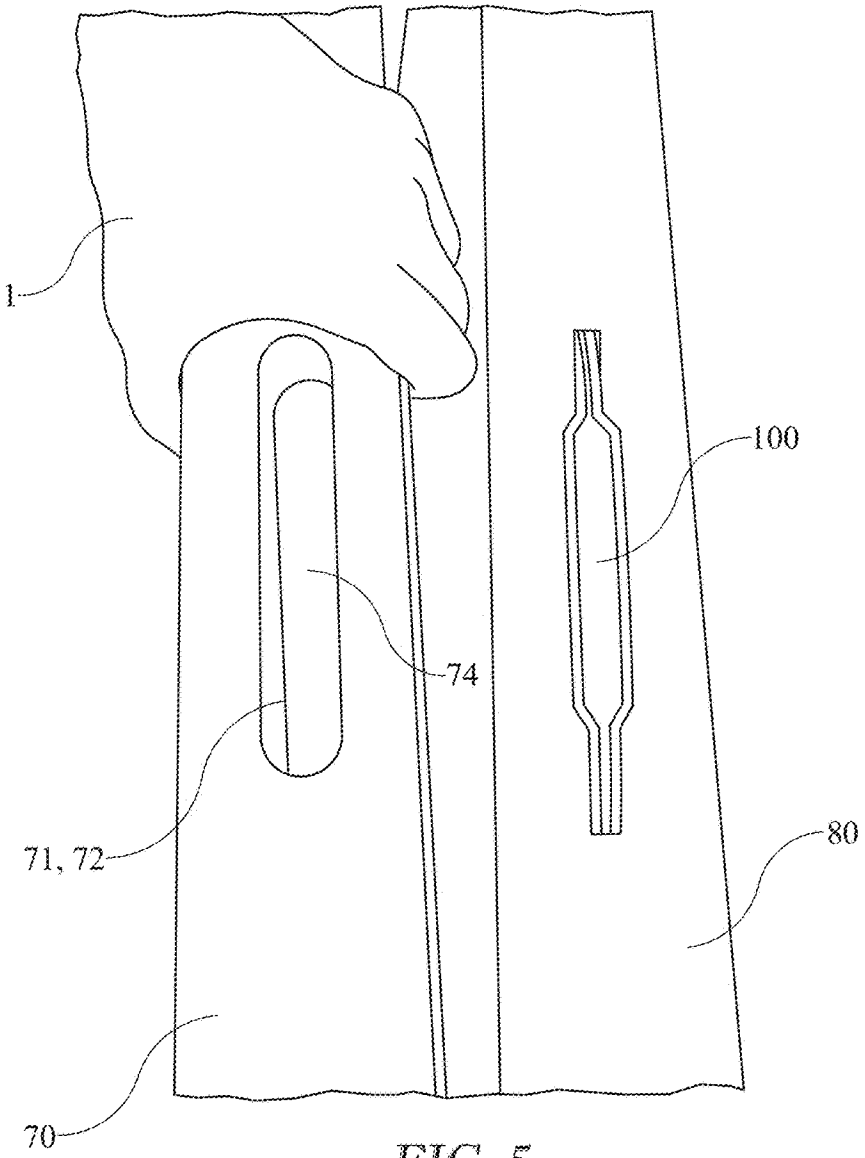
FIG. 5 is a partial perspective view of a handle assembly of a partially assembled carry and storage container in accordance with some embodiments.

Furthermore, and in accordance with some aspects and embodiments, top front panel 80 may be provided with a pair of handle tab apertures 82 that act to accept and secure a collapsible carrying handle 100. As best depicted in FIGS. 2 and 4, tab apertures 82 may be reinforced by a reinforcement tab 84 that includes a spaced pair of apertures 86 therethrough that correspond to and cooperate with handle tab apertures 82. Reinforcement tab 84 may be constructed of material 22 that is identical to or compatible with substrate 20, and further may be secured or affixed to the interior of top front panel 80 by a suitable adhesive.

Figure 7:
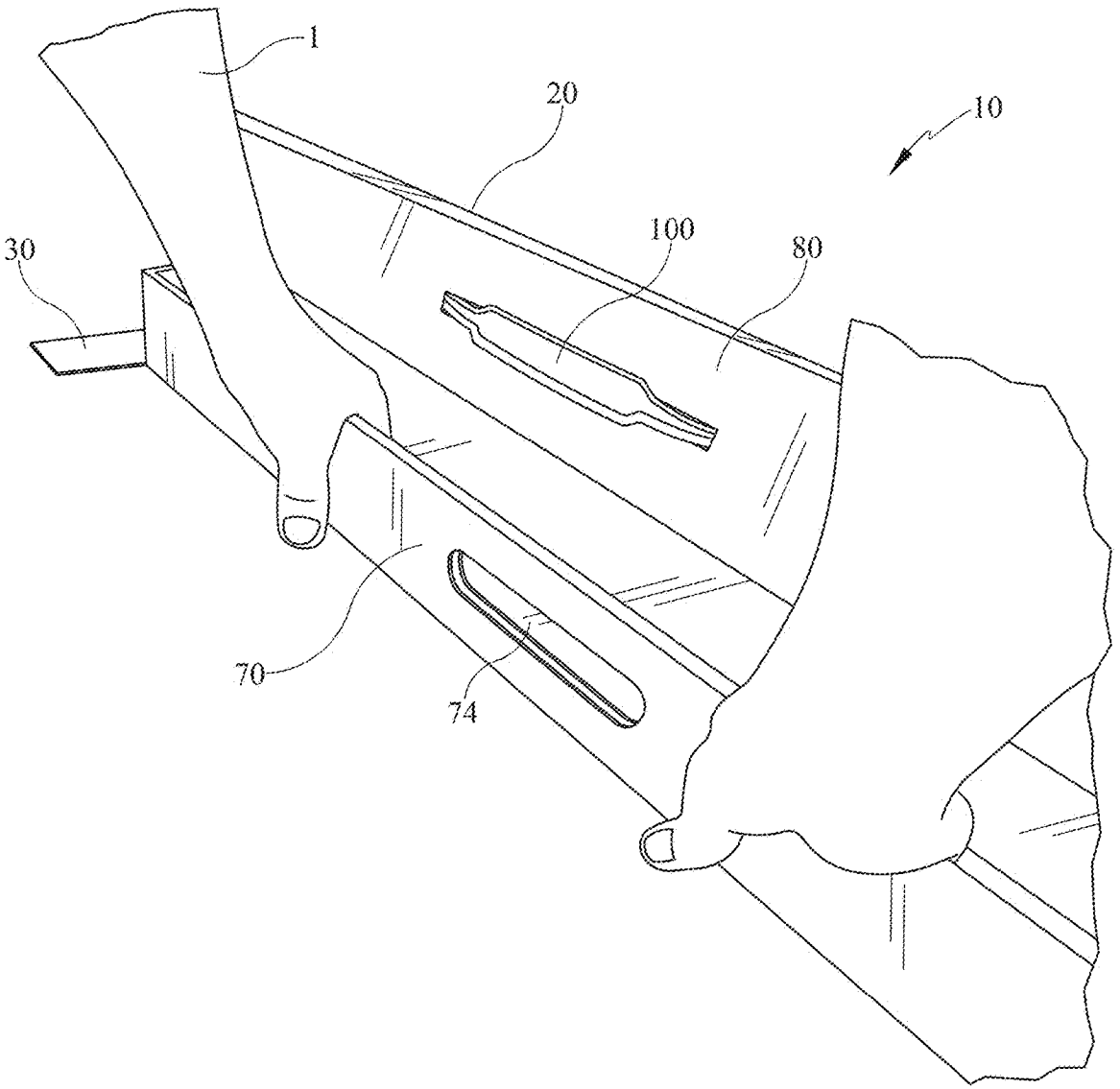
FIG. 7 is a partial perspective view of a carry and storage container showing the planar material having a handle opening folded double the aligned handle openings in accordance with some embodiments.
Figure 8:
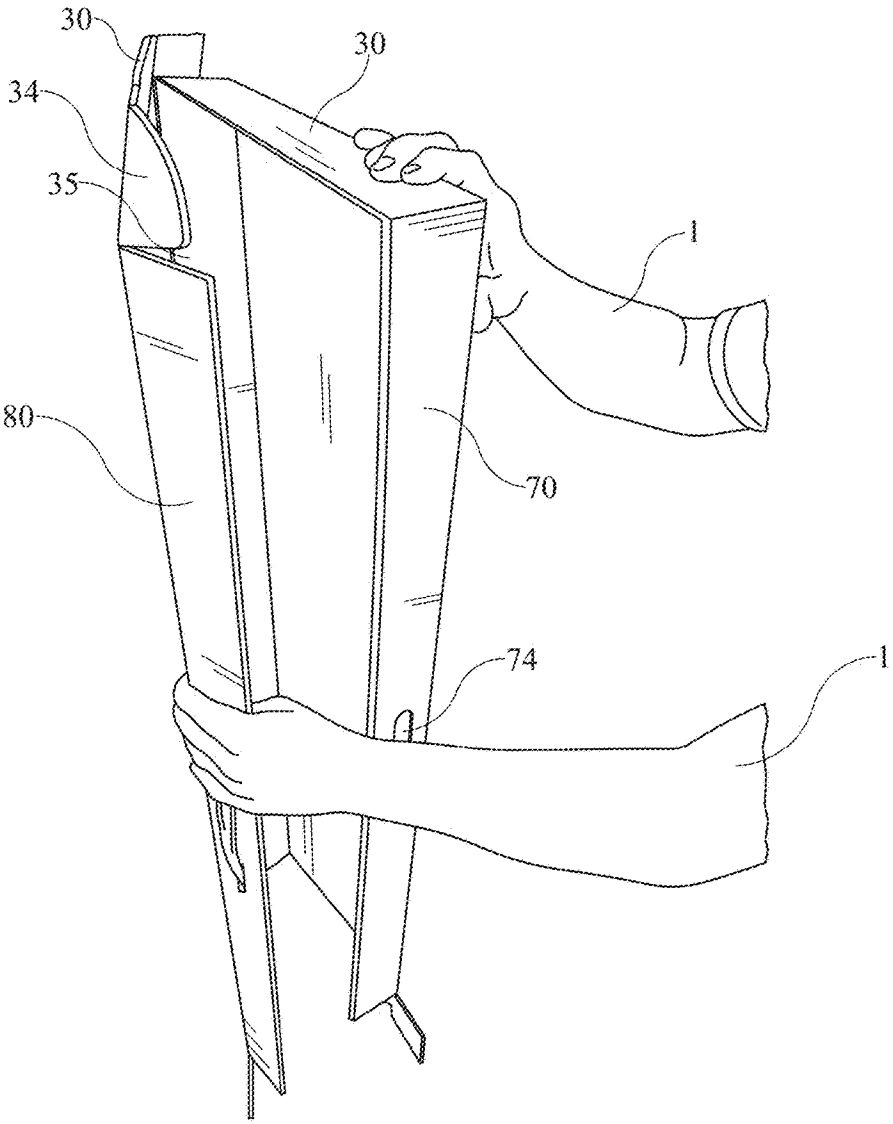
FIG. 8 is a perspective view of a carry and storage container during assembly in accordance with some embodiments.
Figure 9:
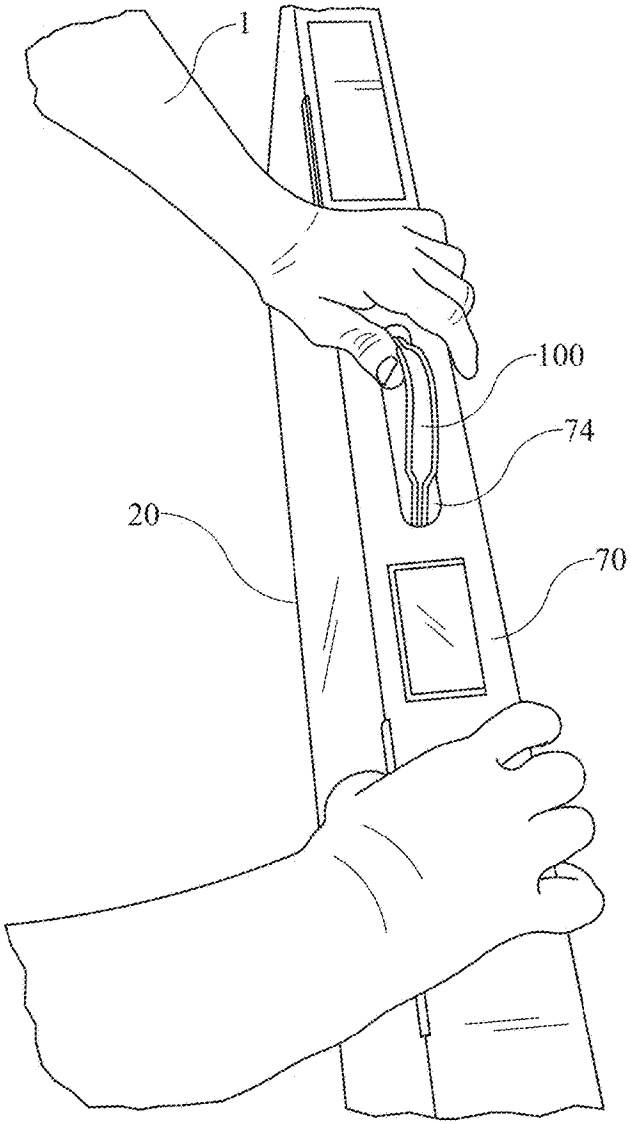
FIG. 9 is a partial perspective view of a carry and storage container during assembly in accordance with some embodiments.

Collapsible handle 100 may include a central member 102 shaped to provide a comfortable grip for a human hand that terminates in either end at attachment tabs 104. In some embodiments collapsible handle 100 may be constructed of a flexible high-strength plastic polymer or the like, although a wide variety of materials may be used for collapsible handle 100. Attachment tabs 104 may be turned and inserted through overlapping apertures 82, 86 such that tabs 104 "catch" or rest on reinforcement tab 84 thus securing handle 100 to container 10. When assembling container 10, handle 100 central member 102 can then be inserted from below upward through single handle slot 74 as best seen in FIGS. 7 and 9.

In accordance with some aspects and embodiments, substrate 20 is sized to form a container 10 that can accommodate conventional shingles sizes, with some exemplary substrate dimensions depicted in FIG. 3. In some embodiments, substrate 20 is sized to accommodate shingles that are in a range of 12 to 18 inches wide and 36 to 40 inches long and less than ½ inch thick. For example, where a container 10 is sized for a bundle of 12 conventional shingles, the long opposed sides may be 47½ inches in length while the short sides may be 41 9/16 inches in length. However, it will be appreciated that substrate 20 may be sized and shaped to provide a container 10 that is capable of storing larger or smaller contents without departing from the scope of the disclosed embodiments.

As depicted in FIGS. 4-11 container 10 is readily and easily constructed by a user 1 by folding substrate 20 along all creases 28, and orienting rear end panel 40, bottom front panel 70 and top front panel 80 at 90 degree angles to both top panel 50 and bottom panel 60. Bottom front panel sections 71, 72 are overlapped such that handle slots 74 are aligned to provide a space for handle 100 central member 102. Handle 100 tabs 104 are inserted into top front panel 80 apertures 82 and reinforcement tab 84 apertures 86 to secure handle 100 to top front panel 80.

Figure 6:
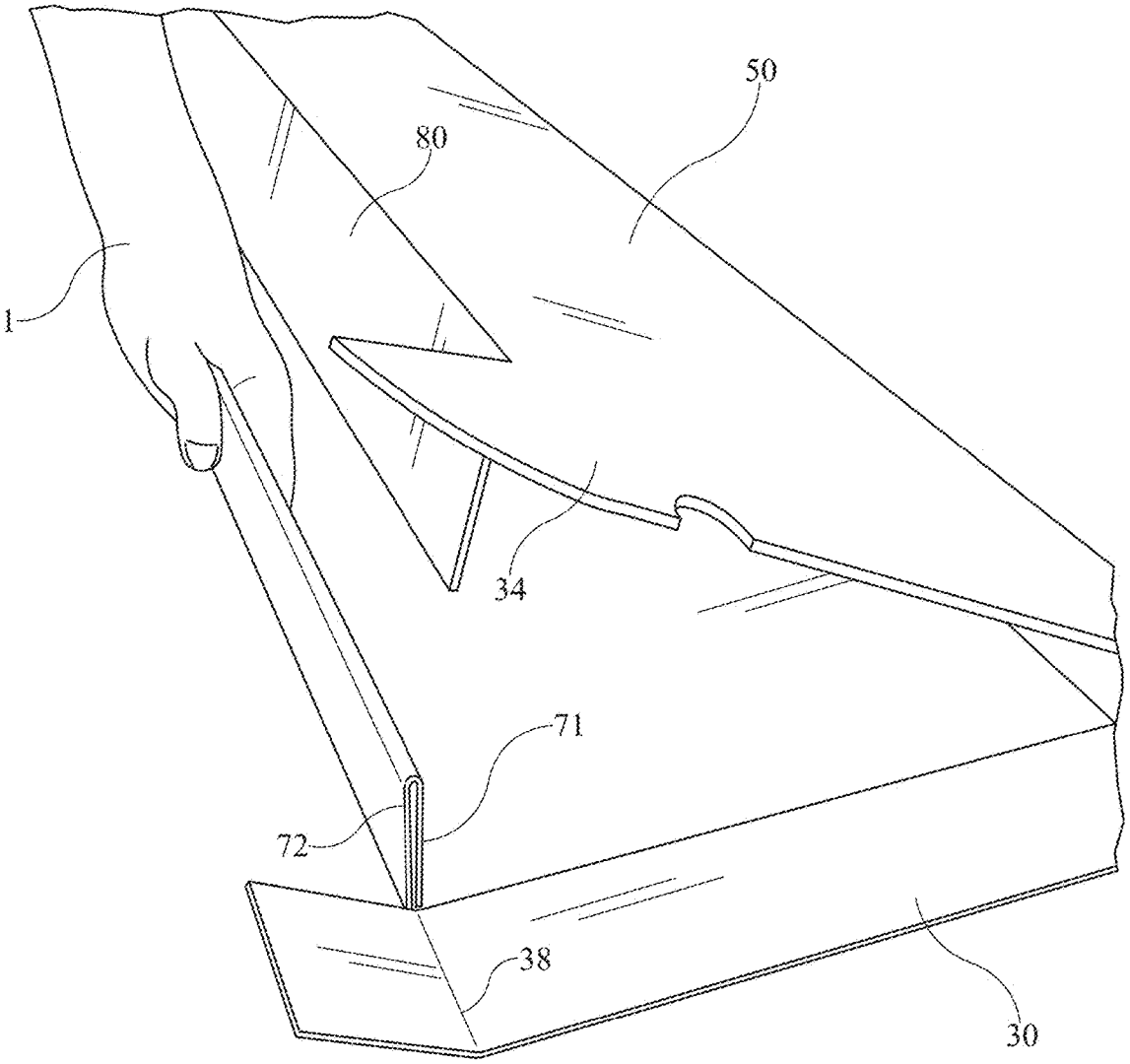
FIG. 6 is a partial perspective view of a carry and storage container showing the planar material having a handle opening folded and partially assembled in accordance with some embodiments.
Figure 10:
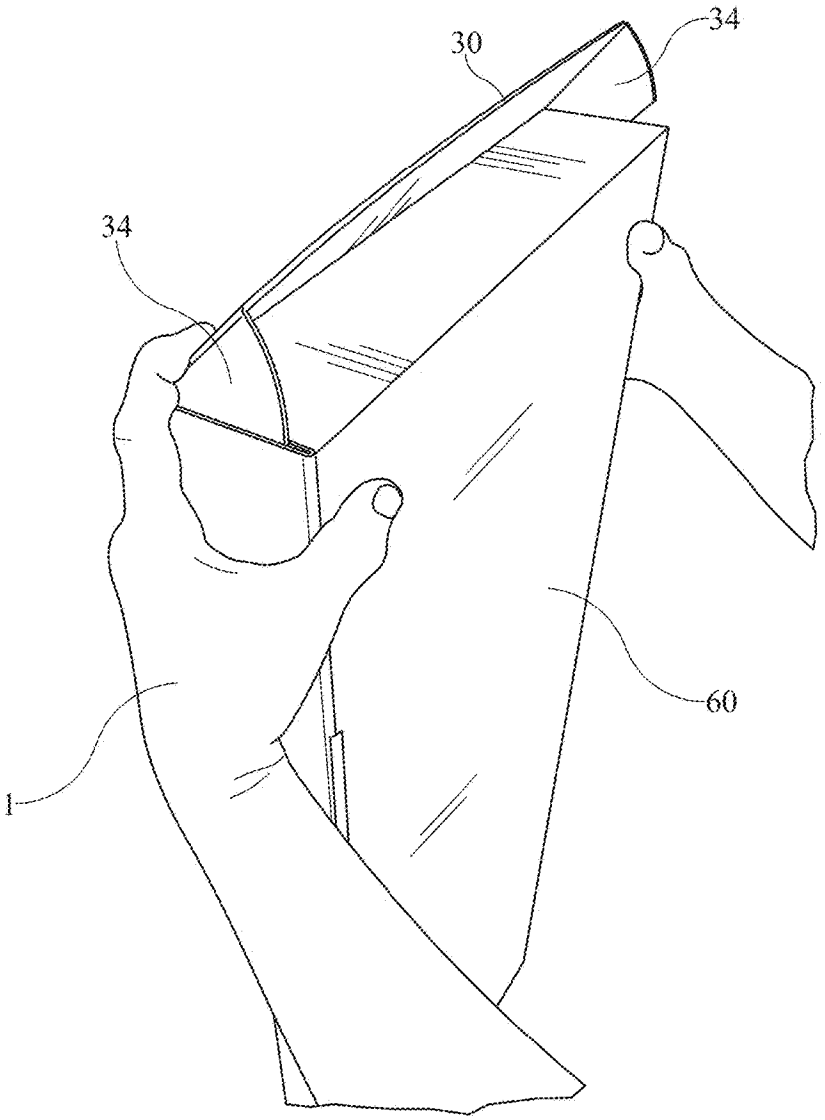
FIG. 10 is a partial perspective view of a carry and storage container during assembly in accordance with some embodiments.
Figure 11:
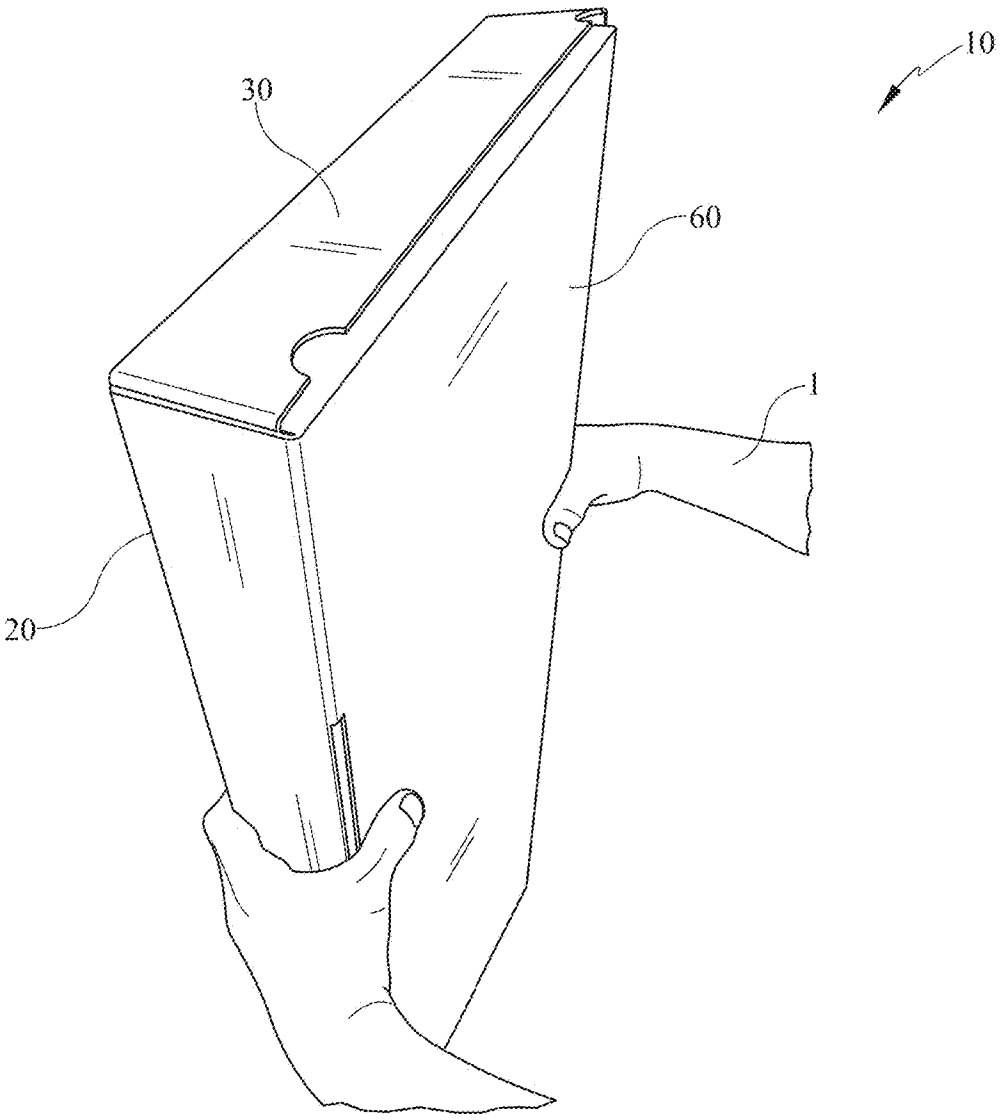
FIG. 11 is a perspective view of an assembled carry and storage container in accordance with some embodiments.

Side panels 30 are also folded at a 90 degree angle to top panel 50 and bottom panel 60, and top end tabs 34 are inserted into the slot created by bottom front panel sections 71, 72, as best seen in FIGS. 6, 10 and 11, thereby creating an assembled container 10. Container 10 may be opened and closed by simply inserting handle 100 through handle slot 74.

In a yet further embodiment as depicted in FIGS. 3 and 9, a plastic pocket 110 may be affixed on bottom front panel 70 on an exterior surface thereof that is shaped and sized to accommodate a business card, or a folded sheet of paper or the equivalent that provide a homeowner with contact information regarding their roofing professional and/or shingle manufacturer. Plastic pocket 110 may in some embodiments be a simple plastic sheet that is secured to bottom front panel 70 with an adhesive along three sides, or it may be a re-sealable flap-closure pocket or envelope affixed to bottom front panel 70. Additionally, a plastic pocket may in some embodiments be secured to an interior portion of said container 10. This feature of the invention provides the roofer or installer of the shingles a convenient place to provide contact information to a homeowner, thereby providing the homeowner or user 1 with the ability to quickly locate their roofer in the event they've lost a shingle, or to locate a manufacturer or sales representative in the event they require additional spare shingles.

While a variety of inventive embodiments have been described and illustrated herein, those of ordinary skill in the art will understand that a variety of other methods, systems, and/or structures for performing the function and/or obtaining the results, and/or one or more of the advantages described herein are possible, and further understand that each of such variations and/or modifications is within the scope of the inventive embodiments described herein. Those skilled in the art will understand that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

While the present invention has been shown and described herein in what are considered to be exemplary embodiments thereof, illustrating the results and advantages over the prior art obtained through the aspects disclosed, the apparatus is not limited to those specific embodiments. Thus, the forms of the invention shown and described herein are to be taken as illustrative only and other embodiments may be selected without departing from the scope of the present invention, as set forth in the claims appended hereto.

We claim:

1. A shingle carry and storage container, comprising:

a single piece of flexible continuous and contiguous planar substrate having a pair of opposed long sides and a pair of opposed short sides to form a generally rectangular shape;

a plurality of spaced parallel longitudinal creases in said substrate that define a rear end panel, a top panel, a bottom panel, a bottom front panel, and a top front panel; and a pair of opposed parallel side creases in said substrate spaced from said short sides of the planar substrate normal to said longitudinal creases to define a pair of opposed side panels, each side panel having a top end tab proximate said top panel;

and wherein said bottom front panel comprises a longitudinal crease dividing said bottom front panel into two front panel sections that are folded to overlap each other and engage said top front panel to provide three layers of substrate when said container is assembled.

2. The shingle carry and storage container of claim 1, wherein said substrate comprises at least one layer of corrugated paper.

3. The shingle carry and storage container of claim 1, wherein said substrate comprises a plurality of corrugated paper layers.

4. The shingle carry and storage container of claim 1 further comprising:

a handle secured to said top front panel for carrying said container.

5. The shingle carry and storage container of claim 4 further comprising:

a reinforcement tab having a spaced pair of apertures therein, said reinforcement tab secured to an interior portion of top front panel;

a pair of handle tab apertures disposed in said top front panel that communicate with the apertures of said reinforcement tab; and wherein said handle includes a central member that terminates in either end at attachment tabs that are inserted through said reinforcement tab apertures and said handle tab apertures for securing said handle to said top front panel.

6. The shingle carry and storage container of claim 5 comprising:

a handle slot disposed in each bottom front panel section arranged so that when said bottom front panel sections are folded the handle slots communicate; and wherein the central member of said handle is positioned through said handle slots when said bottom front panel and said top front panel are placed in an overlapping position, thereby closing said container.

7. The shingle carry and storage container of claim 6 wherein said substrate opposed long sides are up to 47½ inches in length and the opposed short sides are up to 41⁹⁄₁₆ inches in length.

8. The shingle carry and storage container of claim 1 further comprising:

a pocket secured to an exterior portion of said container for carrying storing information relevant to shingles carried and stored in said container.

9. The shingle carry and storage container of claim 1 further comprising:

a pocket secured to an interior portion of said container for carrying storing information relevant to shingles carried and stored in said container.

10. The shingle carry and storage container of claim 1 further comprising:

a cut in each opposed side panel proximate a midpoint thereof to facilitate folding and assembly of said container.

11. The shingle carry and storage container of claim 1 wherein said top end tabs are shaped to engage said bottom front panel edges when said container is assembled.

12. A shingle carry and storage container, comprising:

a single piece of flexible continuous and contiguous planar substrate having a pair of opposed long sides and a pair of opposed short sides to form a generally rectangular shape;

six spaced parallel longitudinal creases in said substrate that define a rear end panel, a top panel, a bottom panel, a bottom front panel, and a top front panel; and two opposed parallel side creases in said substrate spaced from said short sides of said substrate normal to said longitudinal creases to define a pair of opposed side panels, each side panel having a top and bottom end tabs defined by side creases and a cut proximate a midpoint thereof;

wherein said bottom front panel comprises two longitudinal creases dividing said bottom front panel into two front panel sections that are folded to overlap each other and engage said top front panel when said container is assembled.

13. The shingle carry and storage container of claim 12, wherein said substrate comprises at least one layer of corrugated paper.

14. The shingle carry and storage container of claim 12, wherein said substrate comprises a plurality of corrugated paper layers.

15. The shingle carry and storage container of claim 12 further comprising:

a handle secured to said top front panel for carrying said container.

16. The shingle carry and storage container of claim 15 further comprising:

a reinforcement tab having a spaced pair of apertures therein, said reinforcement tab secured to an interior portion of top front panel;

a pair of handle tab apertures disposed in said top front panel that communicate with the apertures of said reinforcement tab; and wherein said handle includes a central member that terminates in either end at attachment tabs that are inserted through said reinforcement tab apertures and said handle tab apertures for securing said handle to said top front panel.

17. The shingle carry and storage container of claim 16 comprising:

a handle slot disposed in each bottom front panel section arranged so that when said bottom front panel sections are folded the handle slots communicate; and wherein the central member of said handle is positioned through said handle slots when said bottom front panel and said bottom rear panel are placed in an overlapping position, thereby closing said container.

18. The shingle carry and storage container of claim 17 wherein said substrate is sized to form a constructed container that can enclose shingles between 12-18 inches in width and 26-40 inches in length.

19. The shingle carry and storage container of claim 12 further comprising:

a pocket secured to an exterior portion of said container for carrying storing information relevant to shingles carried and stored in said container.

20. The shingle carry and storage container of claim 12 wherein said top end tabs are shaped to engage said bottom front panel edges when said container is assembled.

* * * * *